United States Patent [19]

Ellis

[11] Patent Number: 4,985,007

[45] Date of Patent: Jan. 15, 1991

[54] SWIMMING LANE MARKER SYSTEM

[75] Inventor: Herbert S. Ellis, Menands, N.Y.

[73] Assignee: Aquatic Amusement Associated, Ltd., Cohoes, N.Y.

[21] Appl. No.: 424,051

[22] Filed: Oct. 19, 1989

[51] Int. Cl.[5] ..... B63B 51/00

[52] U.S. Cl. ..... 441/133; 4/496; 248/499; 248/301

[58] Field of Search ..... 114/218; 441/133; 4/496, 497, 505, 510; 410/101, 106, 110; 248/499, 301; 24/115 R, 129 B

[56] References Cited

U.S. PATENT DOCUMENTS

| | | | |
|---|---|---|---|
| 2,117,982 | 5/1938 | Prince, Jr. | 4/505 |
| 2,721,354 | 10/1955 | Anderberg | 24/129 B |
| 3,905,322 | 9/1975 | Peterman et al. | 114/218 |
| 3,972,077 | 8/1976 | Whitten, Jr. | 4/496 |

*Primary Examiner*—Sherman Basinger
*Attorney, Agent, or Firm*—Heslin & Rothenberg

[57] ABSTRACT

A swimming lane marker system employs an anchor clip connected at each end of a lane marker cable, the clip having a pin for insertion in an aperture on the gutter-facing side of a gutter lip or similar structure at water level.

5 Claims, 2 Drawing Sheets

SWIMMING LANE MARKER SYSTEM

This invention concerns an improved swimming lane marker system.

Swimming lane marker systems, as currently known, employ a cable which extends from one side of the pool to another with lane marker floats strung along its length. The cable is attached at each end to a fixture which is embedded in the wall of the pool somewhat below the water level. In some instances, the cable is connected instead to the end wall of the pool just above the gutter. There are disadvantages to both arrangements.

In the first place, it is undesirable to connect the lane marker cable below the water level because the first several feet of marker floats are thereby drawn downwardly below the water level. It is also undesirable to connect the marker cable above the gutter lip because the cable then must pass across the gutter, thereby creating a hazard upon which swimmers can trip and fall. Additionally, the cable usually rubs against the top surface of the gutter lip causing it to become scratched and otherwise defaced. A further disadvantage with existing arrangements is that lanes can only be established where fixtures have been installed in the walls of the pool for the attachment of the marker cables. Since the fixtures in question involve obvious and permanent defacement, they are usually limited in number. Further, most existing lane anchors present a potential toe or finger accident location when not in use.

BRIEF DESCRIPTION OF THE INVENTION

The present invention overcomes all of these difficulties and offers several benefits and advantages not available in existing systems. The swimming lane marker system of this invention is comprised of a gutter lip having a plurality of anchor clip mounting sites at spaced intervals along its length, an elastic marker cable having a plurality of marker floats strung along its length and a pair of special anchor clips attached to either end of the marker cable and configured for making an interlocking relationship with the gutter lip when drawn against it by means of sufficient tension in the marker cable.

DETAILED DESCRIPTION OF THE INVENTION

Figure 1:
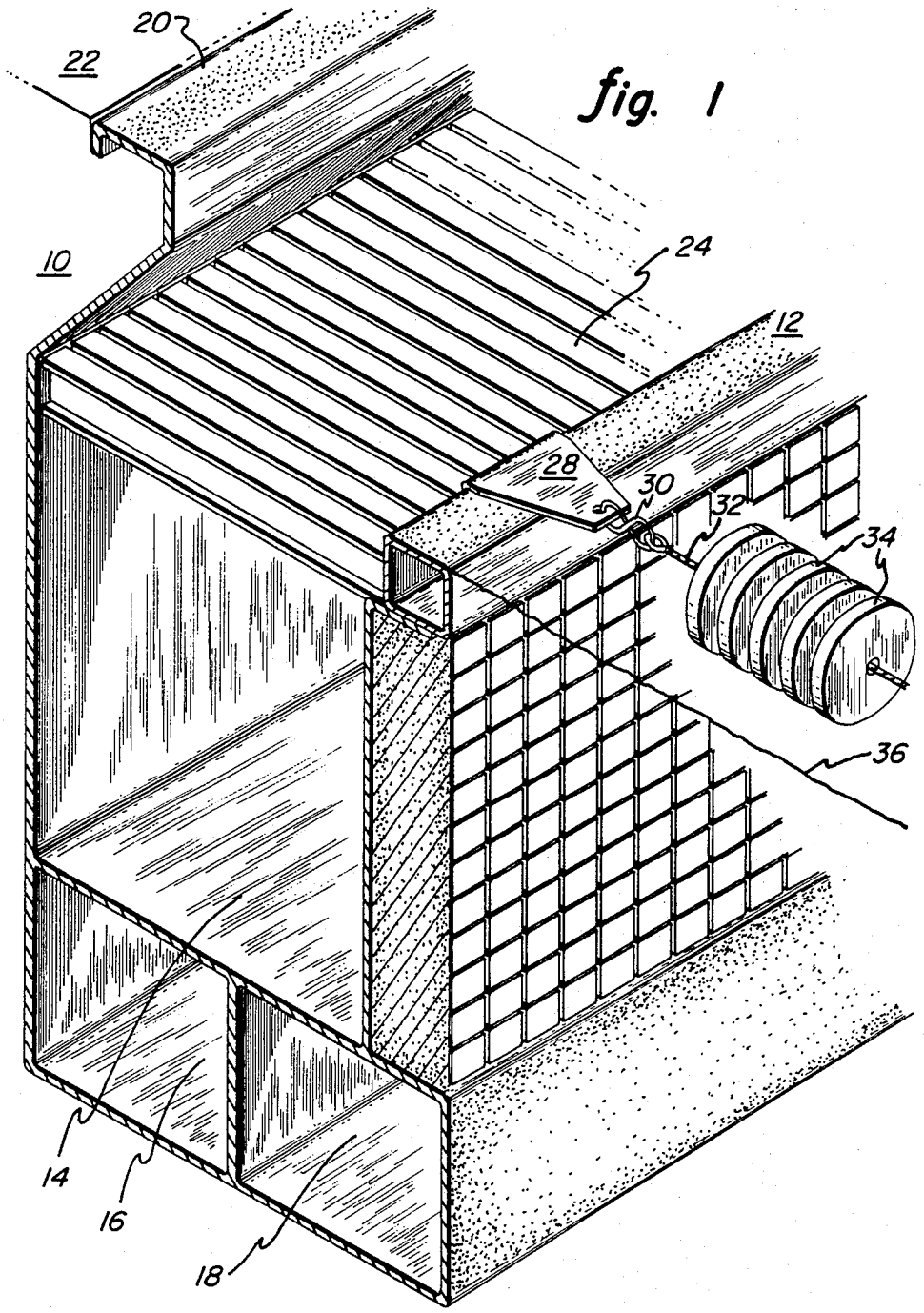
FIG. 1 is a cross-sectional view of a gutter system showing the swimming lane marker system of this invention in use.

Referring to FIG. 1, a gutter and filtered water supply system 10 is shown. It includes a primary overflow channel 14, secondary overflow channel 16, filtered water return conduit 18, safety grate 24, deck nosing 20 and gutter lip 12. These parts are familiar to those skilled in the art. Gutter system 10 is installed around a swimming pool and the surrounding deck 22 is level with the horizontal surface of nosing 20.

Figure 2:
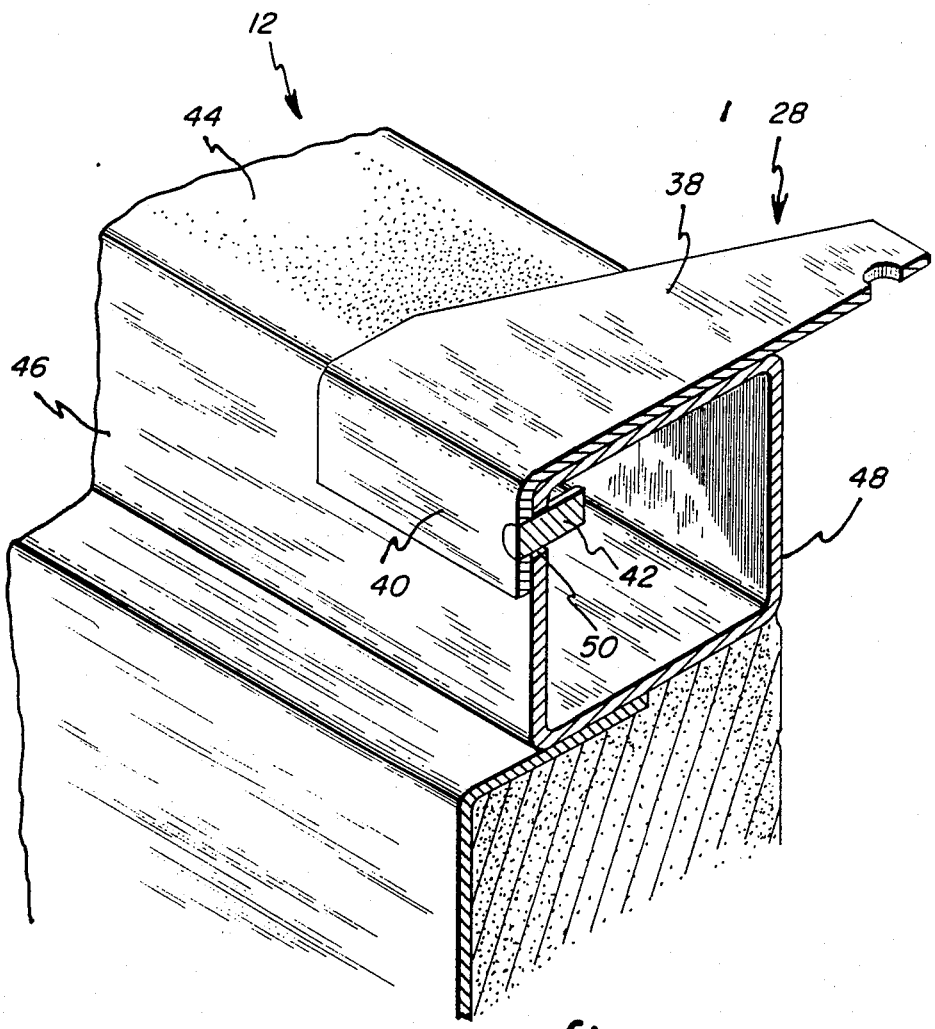
FIG. 2 is a longitudinal, central cross-sectional view taken through the anchor clip of FIG. 1 and shown in interlocking relationship with the gutter lip.

Also shown in FIG. 1 is one end of the swimming lane marker system of this invention which is comprised of an anchor clip 28, S-hook 30, marker cable 32, float marker 32 and gutter lip 12. It will be understood that cable 32 extends to an opposite side of the pool (not shown) where it is attached to the gutter lip 12 by means of another anchor clip 28. In FIG. 2, it may be seen that anchor clip 28 is in an interlocking relationship with gutter lip 12. This is so because anchor clip 28 is comprised of a top plate 38 and a rear plate 40 connected in a configuration which complements two of the exterior surfaces of gutter lip 12. More specifically, gutter lip 12 is comprised of a pool-facing surface 48, a top surface 44 and a gutter-facing surface 46. The configuration of clip 28 complements that of top and rear-facing surfaces 44 and 46 so as to fit around them. Clip 28 is provided with a pin 42 and the gutter-facing surface 46 is provided with an aperture 50 through which pin 42 protrudes when clip 28 is fitted around gutter lip 12 as shown. The interlocking relationship between clip 28 and gutter lip 12 is maintained when rear plate 40 of clip 28 is drawn against gutter-facing surface 46 by means of tension maintained in marker cable 32. (See FIG. 1.)

Referring now to FIG. 1, it will be seen that the top surface of gutter lip 12 defines the water level 36 in the pool. Thus, the use of the specially configured anchor clip 28 results in locating the level of marker cable 32 precisely at water level, a distinct advantage over most, if not all, presently known systems. In addition, it will be readily appreciated that mounting sites for anchor clip 28 can be created along gutter lip 12 by simply drilling holes in gutter-facing surface 46 wherever such mounting sites are desired. This can, of course, be done in the field. A further advantage of the swimming lane marker system of this invention is that there need be no unsightly fixtures embedded in the side of the pool below water level or in the end wall 20 on the edge of the deck. Furthermore, there is no cable extending across the gutter, thus avoiding a hazard which can cause tripping. A final advantage of this invention is that all of the fixtures and hardware used to define swimming lanes, including the clips 28 and excepting only gutter lip 12, are removed from the pool in one package whenever desired. This is so because the clip is detached from gutter lip 12 and simply rolled up with marker cable 32.

In operation, the swimming lane marker system of this invention is installed at opposing mounting sites on lip 12. Opposing mounting sites are generally located in opposite walls of the pool, but can, of course, be arranged in other configurations as well. Each swimming lane marking cable is provided with an anchor clip 28 on each end and is installed by mounting one end and then pulling the other anchor clip with sufficient force to bring it over the opposite gutter lip and then allowing the tension in cable 32 to draw it into interlocking engagement with lip 12. The cable, of course, must be of suitable length and elasticity for each installation. The elasticity of the cable need not be great so long as it is sufficient to permit enough stretching of the cable to make the installation described. The same purpose could, of course, be served by using an inelastic cable provided with springs or other stretching elements somewhere along its length or between the cable and anchor clip 28.

There are many modifications which could be made in the above-described preferred embodiment of the subject invention. For example, instead of providing anchor clip 28 with a pin 42, one could provide a pin or a lug of some type on the gutter-facing surface of gutter lip 12 and form a suitable aperture in rear plate 40 of anchor 28 for interlocking engagement with the lug. Furthermore, several pins or lugs could be used instead of using only one. Also, those skilled in the art will realize that the gutter system shown in the drawings is but one type. There are many different types of gutter systems and the invention described herein may be applied to most, if not all, of them. In some gutter systems, for example, the gutter lip forming the curb or pool edge serves as a filtered water pressure return conduit. In such cases, use of the subject invention might very well involve the use of a welded and sealed tube or socket inserted into the gutter lip (instead of a simple aperture 50) in order to contain the pressurized water therein. Obviously, such an arrangement would work just as well as that described above and would accomplish the same objectives. Furthermore, one could choose to configure an anchor clip which is not complementary to that of the gutter lip while still employing this invention. One could even use a clip with a pin depending from top plate 38 for insertion into an aperture in top surface 44 of lip 12, preferably so located as to hold rear plate 40 (if used) against gutter-facing surface 46. With such an arrangement, the tension in cable 32, although still desirable, would be of less importance. These and other changes which could readily be made are within the spirit of this invention and are intended to be encompassed within the scope of the following claims:

What is claimed is:

1. In a swimming pool, a swimming lane marker system comprised of:

a gutter lip disposed around the pool, said gutter lip having a top surface, a pool-facing surface and a gutter-facing surface and said lip having a plurality of anchor clip mounting sites at spaced intervals therealong;

at least one elastic marker cable having a plurality of marker floats strung along its length; and an anchor clip attached to each end of the marker cable, each clip having a top plate connected to a rear plate and each clip having means for interlocking with the gutter lip at a mounting site when the rear plate of the clip is drawn against the gutter-facing surface;

the length of the cable and its elasticity being such as to permit the two clips to be mounted at opposed mounting sites with a resulting tension in the cable.

2. The invention of claim 1, wherein the gutter lip has an aperture in its gutter-facing surface at at least one anchor clip mounting site and at least one clip has a pin mounted on its rear plate for insertion into the aperture.

3. The invention of claim 2 wherein the top and rear plates of the clip are configured so as to conform to the shape of the top and rear-facing surfaces of the gutter lip when in interlocking relationship therewith.

4. The invention of claim 1 wherein the top and rear plates of the clip are configured so as to conform to the shape of the top and rear-facing surfaces of the gutter lip when in interlocking relationship therewith.

5. A detachable anchor clip for use in a swimming lane marker system comprised of a first plate connected to a second plate generally at a right angle, said second plate having a pin mounted thereon for detachably securing said clip in a fixed position, along the gutter lip of a pool, said pin with its axis and its length running generally parallel to the first plate, wherein an elastic marker cable may be attached to said first plate and said pin inserted into a hole in the inside of a pool gutter lip thereby enabling the tension within the elastic marker cable to prevent the clip from moving from its fixed position.

* * * * *

UNITED STATES PATENT AND TRADEMARK OFFICE

CERTIFICATE OF CORRECTION

PATENT NO. : 4,985,007

DATED : January 15, 1991

INVENTOR(S) : Herbert S. Ellis

It is certified that error appears in the above-identified patent and that said Letters Patent is hereby corrected as shown below:

ON TITLE PAGE:

[73] should read as follows: Aquatic Amusement Associates, Ltd.
Cohoes, New York

Signed and Sealed this

Twenty-first Day of July, 1992

*Attest:*

DOUGLAS B. COMER

*Attesting Officer*

*Acting Commissioner of Patents and Trademarks*